United States Patent [19]

Coulombe et al.

[11] 4,143,608

[45] Mar. 13, 1979

[54] FEED CONTROL SYSTEM

[75] Inventors: Lionel J. Coulombe, Matawan; Edward A. Bruder, Roselle, both of N.J.

[73] Assignee: The Singer Company, New York, N.Y.

[21] Appl. No.: 850,985

[22] Filed: Nov. 14, 1977

[51] Int. Cl.[2] ..... D05B 27/22

[52] U.S. Cl. ..... 112/210; 112/158 A

[58] Field of Search ..... 112/158 A, 158 B, 210

[56] References Cited

U.S. PATENT DOCUMENTS

| | | | |
|---|---|---|---|
| 3,636,900 | 1/1972 | Rogers et al. | 112/210 |
| 3,724,404 | 4/1973 | Marsh et al. | 112/158 B |
| 3,753,411 | 8/1973 | Graham et al. | 112/210 |

FOREIGN PATENT DOCUMENTS

| | | | |
|---|---|---|---|
| 1091842 | 10/1960 | Fed. Rep. of Germany | 112/210 |

*Primary Examiner*—Wm. Carter Reynolds

*Attorney, Agent, or Firm*—Robert E. Smith; Edward W. Goodman; Edward L. Bell

[57] ABSTRACT

A control system for the work feeding mechanism in a cam controlled pattern sewing machine wherein a manual forward feed biasing spring is bypassed when cam control is selected. The control system also features a quick reverse linkage, operable in the manual mode, which may be lockably engaged for hands-off reverse sewing.

4 Claims, 4 Drawing Figures

FEED CONTROL SYSTEM

BACKGROUND OF THE INVENTION

In the work feeding mechanism of a sewing machine, it is highly desirable to have the feed regulating shaft, or its adjuster, heavily biased toward a maximum forward feed setting. This heavy biasing ensures a constant stitch length over an extended period of sewing without said regulating shaft wandering over its range due to vibration. However, with the increasing use of pattern cam systems in sewing machines, wherein a cam selectively controls positioning of the feed regulating shaft, in order to limit wear on the feed regulating cam, devices similar to the one described in U.S. Pat. No. 3,636,900 of Rogers et al, have been necessary for selectively disengaging the foward feed heavy biasing when the work feeding mechanism is being controlled by the feed regulating cam. In the prior art, disengagement was performed by an additional cam acting on a linkage which directly opposed the heavy bias, which, in turn, subjected the disengaging cam to excessive wear and early failure.

SUMMARY OF THE INVENTION

The object of this invention is to provide a work feed control system that, in the manual mode, controls the foward and reverse feed regulating shaft positions, biasing the same toward the foward feed position, and in a cam controlled mode allows adjustment of the feed regulating shaft without the influence of said bias, while not being subject to excessive cam wear. This object is achieved by using a composite slider having two parts, one shiftable with respect to the other, and biasing means thereon constraining the relative movement of said two parts. On positioning a second slider in accordance with manual feed selection, the composite slider will be moved to a related foward feed position and one of the parts thereof will be retained while the other part which is operatively connected to the feed regulating shaft, will be allowed to be shifted, in opposition to the biasing means, to a corresponding reverse feed position. On positioning the second slider to allow for cam feed control, the retained part of the composite slider will be released allowing the two parts to move together as a unit in response to the influence of the cam control system thereby bypassing the biasing means acting between the two parts of the first slider.

DESCRIPTION OF THE DRAWINGS

With the above and additional objects and advantages in view as will hereinafter appear, this invention will be discribed with reference to the following figures.

DESCRIPTION OF THE PREFERRED EMBODIMENT

Figure 1:
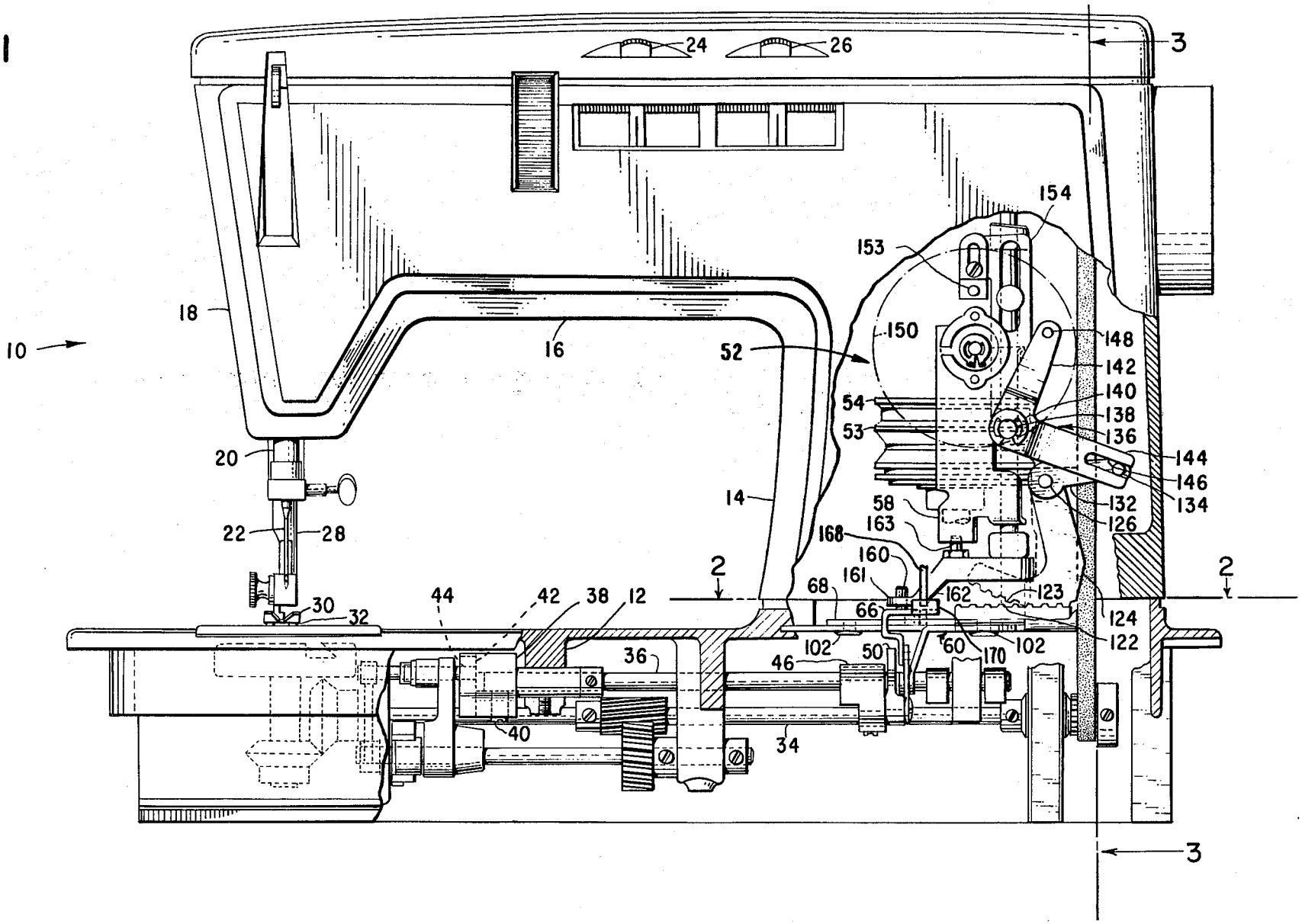
FIG. 1 is a front elevational view of a sewing machine having this invention applied thereto and with portions of the front escutcheon panel and machine frame broken away to expose the mechanism therein forming a part of this invention.

Illustrated in FIG. 1 is a sewing machine referred to by the reference number 10. The sewing machine 10 includes a work supporting bed 12, a hollow standard 14 rising from the bed 12 and a bracket arm 16 extending from the standard 14 and overhanging the bed 12. The bracket arm 16 terminates in a sewing head 18 which carries a needle bar 20, having a thread carrying needle 22 attached to the lower extremity and arranged for endwise reciprocatory motion as well as transverse jogging. Controls 24 and 26 provided along the bracket arm 16 and through suitable linkages (not shown) control the width of jogging and the neutral needle position, respectively.

Also carried within the sewing head 18 is a presser bar 28 having a presser foot 30 pivotally attached to the end thereof. The presser bar 28 is selectively downwardly biased such that the presser foot 30 will press a piece of material being sewn in opposition to a feed dog 32 which is a part of a work feed mechanism located within the bed 12 of the sewing machine 10. The work feed mechanism used with this invention is described in greater detail in U.S. Pat. No. 3,527,183 of Szostak et al, to which reference may be had.

The work feed mechanism is driven by a bed shaft 34 journalled in the bed 12 and includes a stitch length and feed direction regulating rock shaft 36 also journalled in the sewing machine bed 12. A block 38 is fastened by set screw 40 to one end of the rock shaft 36. The block 38 is formed with a channel 42 for accommodating a slide 44. The angular position of block 38 determines the direction and magnitude of work feed. At the other end of the rock shaft 36, a bracket 46 is attached by set screw 48. A cross link 50 connects the bracket 46 with the feed control system 60 of this invention.

A cam control module 52 is carried in the hollow standard 14. The module 52 which is substantially similar to one described in U.S. Pat. No. 3,795,210 of Adams et al, to which reference may be had, includes a cam stack having feed cams 53 and 54, and a feed cam follower 56 with a feed transfer bar 58, both pivotally attached to a feed cam follower support post 59 for transferring feed information on the cam stack to the feed control system 60 of this invention.

The feed control system 60 includes a frame 62 rigidly mounted in the standard 14 of the sewing machine 10 by mounting screws 64. The frame 62 has mounted thereto a composite slider 66 arranged to move in the direction of work feed and a second slider 68 arranged to move transverse the direction of work feed. The composite slider 66 includes a first component part 70 having two elongated slots, 72 and 74, formed lengthwise in opposite ends thereof, and a second component part 76 having two upward extending pins, 78 and 80, so spaced as will slidably engage slots 72 and 74, respectively, in the first component part 70. Spring clips 82 and 84 engage grooves in pins 78 and 80, respectively, thereby slidably retaining the first component part 70 to the second component part 76. A foward feed biasing spring 86 engages pin 80 and a pin 88 extending upwardly from the first component part 70, biasing the first component part 70 rearwardly such that the pins 78 and 80 abut the foward edges of slot 72 and 74. Slots 90 and 92, formed in the frame 62, are arranged to receive shoulder screws 94 which are attached to the second component part 76. The interaction of the screws 94 and the slots 90 and 92 permit the composite slider 66 movement only in the direction of work feed.

Figure 2:
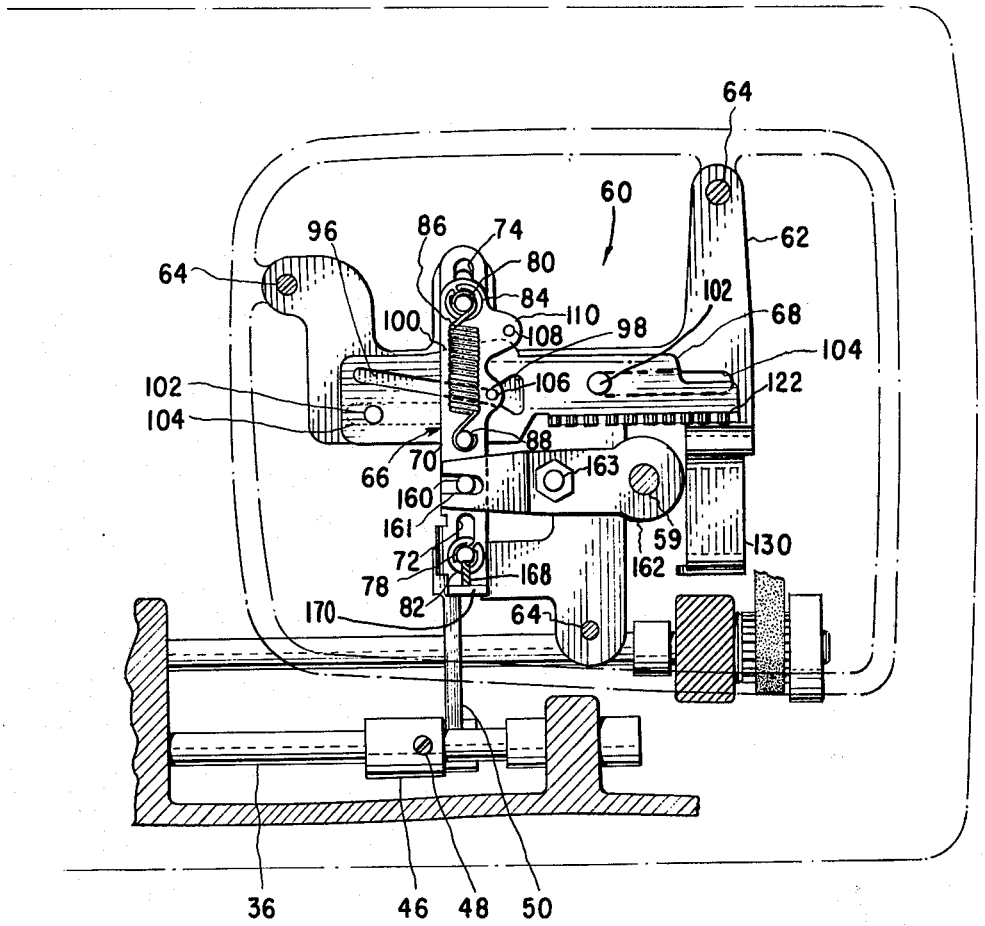
FIG. 2 is a horizontal cross-sectional view taken substantially along the line 2—2 in FIG. 1 showing the composite slider arrangement of this invention.
Figure 3:
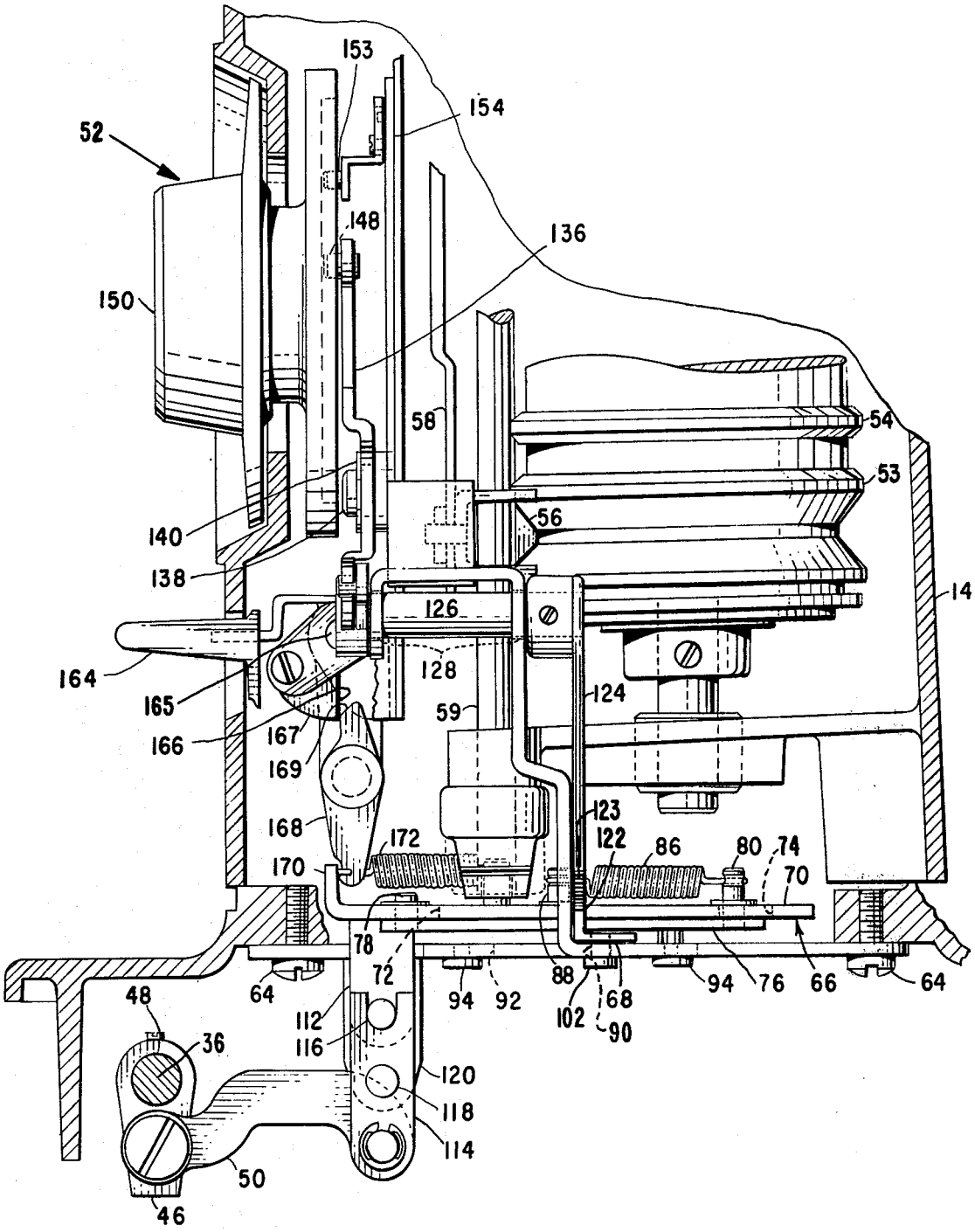
FIG. 3 is a vertical cross-sectional view taken substantially along the line 3—3 in FIG. 1 showing the interaction of the feed control system with the work feed regulating shaft. Also shown is a lockable quick-reverse linkage.
Figure 4:
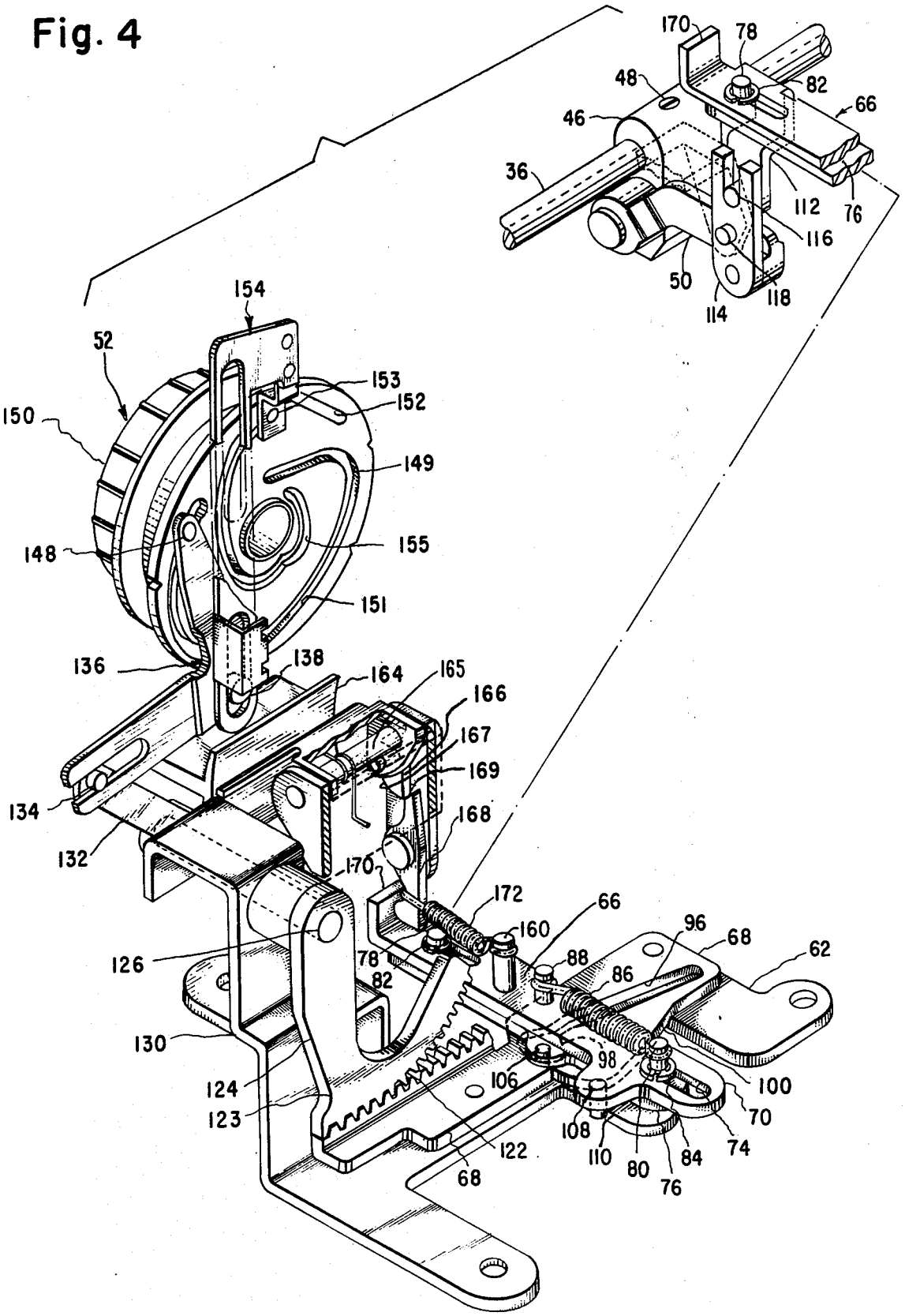
FIG. 4 is a perspective view of the feed control system showing the linkage from the operator influenced dial to the composite slider and to the feed regulating shaft.

Referring to FIG. 2, the second slider 68 is formed with a narrow slot 96 which extends angularly across the slider 68 starting on the left end near the upper edge of the second slider 68 and extending toward the center thereof terminating into a laterally enlarged aperture 98. The edge of the slider 68 opposite the slot 96, is formed with a cam protuberance 100 which extends outwardly from the slider edge at substantially the same angle as the slot 96 extends toward the center of the slider. The second slider 68 mounts directly to the frame 62 using shoulder screws 102 through transverse slots 104 formed in the frame 62. The second slider 68 is so positioned on the frame 62 that the slot 96 containing portion of the second slider 68 underlies the composite slider 66. A pin 106 is mounted to the underside of the second component part 76 for slidably engaging slot 96. A cam following pin 108 is attached to a tab 110 extending from the first component part 70 and is arranged for selective engagement with cam surface 100. It should now be evident, referring to FIG. 2, that when pin 106 is in slot 96, movement of the second slider 68 will result in a lateral movement of the composite slider 66; additional movement of the first component part 70 of the composite slider 66 may be effected by overcoming spring 86 until pin 108 engages cam surface 100. When the pin 106 occupies a position in the laterally enlarged aperture 98, the second component part 76 is allowed to move together with the first component part 70 without flexing the spring 86. The movement of the first component part 70 of the composite slider 66 is transferred to the cross link 50 by means of a downwardly turned tab 112 which pivotally engages a bifurcated link 114 at pivot pin 116. The link 114 is pivotally attached at the midpoint thereof to a pivot pin 118 affixed to a downwardly turned tab 120 appending from the frame 62. The other end of link 114 is pivotally attached to the cross link 50. From the foregoing, it should be noted that the position of the second component part 76, under the influence of pin 106 in slot 96, establishes the manually selected forward feed. By shifting the first component part 70 with respect to the second component part 76 in opposition to the bias of spring 86, pin 108 is brought into engagement with cam surface 100, establishing the manually selected reverse speed which corresponds with the above-mentioned manually selected forward feed.

For manually adjusting the position of the second slider and, in turn, the magnitude of both forward and reverse feed, a rack 122 is formed in an upwardly turned edge of the second slider 68. The rack 122 meshes with a gear segment 123 formed on an actuating lever 124 which is mounted to a shaft 126 passing through coaxial holes 128 in an upward extending arm 130 of the frame 62. A link 132 is also fixedly attached to the shaft 126 and carries a pin 134. A bell crank 136 is pivotally attached at its mid-point to a pin 138 which is anchored to the standard 14 by means of a spring clip 140. The bell crank 136 is formed having two legs 142 and 144; leg 144 being bifurcated at 146 as to slidably engage pin 134, and leg 142 carrying a cam follower pin 148 for tracking a cam groove 149 formed in the inside surface of an operator influenced dial 150.

For pattern cam control of the feed, the cam groove 149 has a dwell portion 151 which, when tracked by cam follower pin 148, positions the laterally enlarged aperture 98 in the second slider 68 opposite the pin 106. During this time, a second cam groove 152, also formed in the inside surface of the operator influenced dial 150, moves a second cam follower pin 153 connected through linkage 154 to the feed cam follower 56 thereby shifting the cam follower 56 axially into tracking relation with one of cams 53 or 54. The cam groove 152 also has a dwell portion 155 corresponding to a parked position for the cam follower 56 during which time the cam groove 149 varies the feed manually.

For pattern cam control of the feed, the first component part 70 of the composite slider 66 carries a guide pin 160 which engages a bifurcated portion 161 of a bracket 162. The bracket 162 is pivotally mounted to the feed cam follower support post 59 and engages at 163 the feed transfer bar 58 of the cam control module 52. Since the pin 106 is now located in the laterally enlarged aperture 98 in the second slider 68, the composite slider 66 may be moved as a unit by the feed transfer bar 58 under influence of pattern cams 53 or 54, bypassing the effects of bias spring 86.

The sewing machine 10 also includes a manual mode quick reverse linkage for manually shifting the upper bar 70 such that pin 108 engages cam 100. This mechanism includes a lever 164 pivotally attached to the sewing machine standard 14. The lever 164 turns on a pivot shaft 165 and includes a cam having a radial section 166 which engages a feed reverse link 168. The feed reverse link 168, also pivotally attached to the standard 14, engages an upwardly turned tab 170 on the first component part 70 of the composite slider 66. By pressure on the lever 164, the cam radial section 166 forces the link 168 to pivot, engaging tab 170 and then moving the first component part 70 from its biased position to a point where the pin 108 engages cam 100. At this point, further pressure on lever 164 causes the end 169 link 168 to engage cam dwell portion 167. The link end 169 is shaped complimental to the cam dwell portion 167 such that the engaging of the end 169 with the cam dwell portion 167 locks the link 168 in position until manually released by raising lever 164. A return spring 172 is attached to the link 168 and the first component part 70 at pin 160.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of this invention, what is herein claimed is:

1. In a sewing machine having a work feeding mechanism including a means responsive to the angular position of a feed regulating shaft for varying the magnitude and direction of work feed, manual forward and reverse feed adjusting means for establishing a selected forward feed and a selected reverse feed and a pattern cam system for selectively adjusting forward and reverse feed, a feed control system for operatively interconnecting said manual feed adjusting means and said pattern cam system with said feed regulating shaft comprising:

a composite slider shiftably supported for linear movement, including a first and a second component part, said first component part relatively shiftable to said second component part and operatively connected to said feed regulating shaft and said pattern cam system;

means for biasing said first component part toward one extreme position relative to said second component part representing the selected forward feed;

an operator influenced setting device for selectively applying said manual feed adjusting means to said composite slider for the positioning of said first and said second component parts jointly; and a manual reverse feed actuating means effective to impart movement to said composite slider first component part relative to said second component part in opposition to said biasing means to a position corresponding with the selected reverse feed.

2. A feed control system as set forth in claim 1 wherein said operator influenced setting device together with said manual feed adjusting means comprise:

a second slider shiftably supported for linear movement in an intersecting path with said composite slider;

means on said second slider for determining a selected forward feed position of said composite slider second component part and a corresponding selected reverse feed position of said composite slider first component part; and means on said second slider for bypassing said biasing means whereby said composite slider first component part may be shifted jointly with said second component part between forward and reverse feed positions by said pattern cam system without the influence of said biasing means.

3. A feed control system as set forth in claim 2 wherein said determining means comprises said second slider being formed with a narrow slot extending angularly thereacross; said second slider having a cam protuberance formed along the edge thereof opposite said slot; a first pin mounted to said composite slider second component part for engaging said slot; and a second pin mounted to said first component part for selectively engaging said cam surface.

4. A feed control system as set forth in claim 3 wherein said means for bypassing said bias comprises said narrow slot in said second slider opening into laterally enlarged aperture in which said first pin may shiftably move, thereby allowing said second component part of said composite slider, otherwise constrained by said first pin captured in said narrow slot, to shiftably move with said first component part thereby overriding the action of said biasing means.

* * * * *